US005608997A

United States Patent [19]

Mahowich

[11] Patent Number: 5,608,997

[45] Date of Patent: Mar. 11, 1997

[54] VERTICAL LOG BUILDING AND METHOD FOR CONSTRUCTING THE SAME

[76] Inventor: Alexander E. Mahowich, P.O. Box 223, Van Anda, British Columbia, Canada, V0N 3K0

[21] Appl. No.: 610,203

[22] Filed: Mar. 4, 1996

[51] Int. Cl.[6] ..... E04B 1/10

[52] U.S. Cl. ..... 52/233

[58] Field of Search ..... 52/233

[56] References Cited

U.S. PATENT DOCUMENTS

| | | | |
|---|---|---|---|
| 4,443,990 | 4/1984 | Johnson | 52/233 |
| 4,787,185 | 11/1988 | Gascho | 52/233 |
| 4,807,413 | 2/1989 | Randall | 52/233 |
| 4,951,435 | 8/1990 | Beckedorf | 52/233 |
| 4,967,526 | 11/1990 | Yost | 52/233 |
| 5,058,343 | 10/1991 | Nipko | 52/233 |
| 5,060,432 | 10/1991 | Christian | 52/233 |
| 5,161,519 | 11/1992 | Christian | 52/233 X |

*Primary Examiner*—Wynn E. Wood
*Assistant Examiner*—Beth Aubrey

[57] ABSTRACT

A vertical log building and method for constructing the same including a foundation that has a floor plate attached an upper portion. A plurality of wall structures that are secured to the foundation. Each wall structure has a plurality of vertically oriented logs disposed side by side and a plurality of corner logs. One of the vertical logs joining to one of the corner logs. Each log has two sides that have a pair of slots therein. Each of the plurality of vertical logs have an L-shaped notch at a floor end and a ceiling end. The L-shaped notch allows each vertical log to have an inner side. The L-shaped notch of the floor end is secured to the floor plate. Each corner log has a frontal area with a plurality of slots. The plurality of slots form two outer slots and two inner slots. The floor end and the ceiling end of each corner log has a generally V-shaped notch for attaching the corner log to the floor plate. Lastly, a plurality of planks are positioned within the slots of the vertical logs to form the plurality of wall structures.

12 Claims, 4 Drawing Sheets

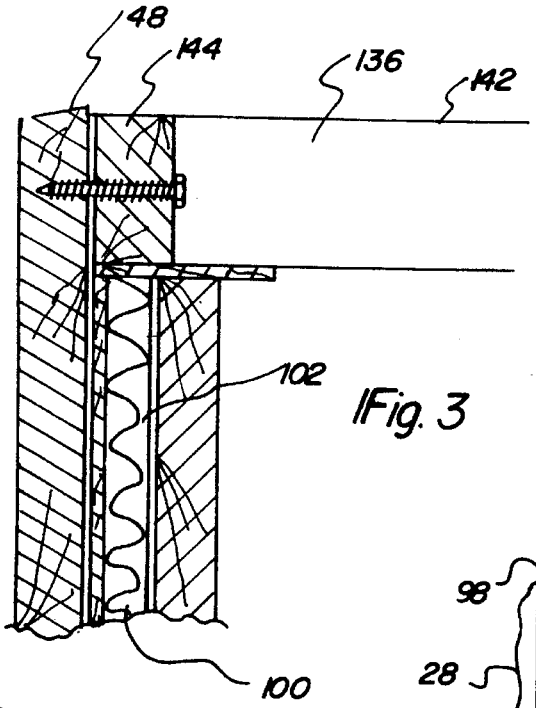
Fig. 3
Fig. 4
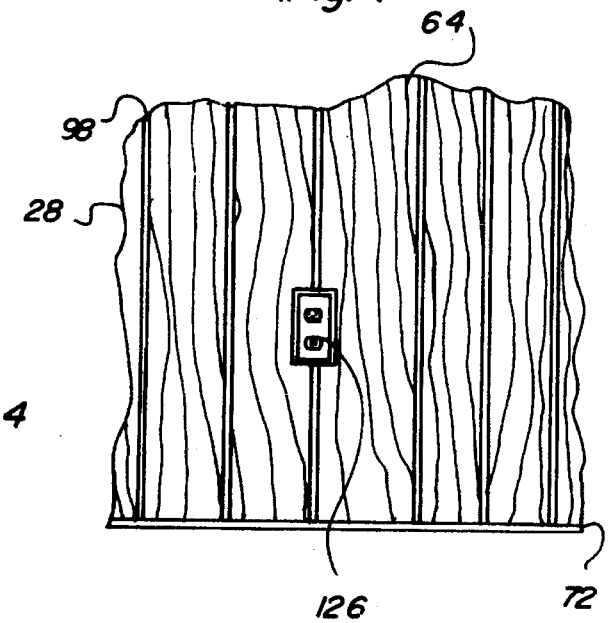
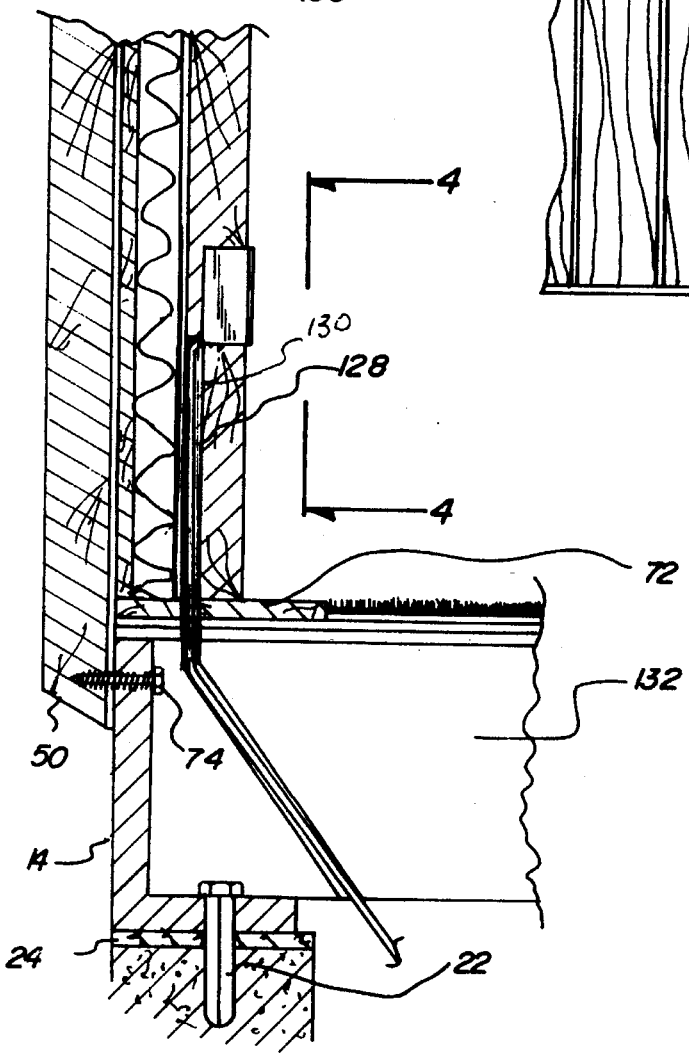

110
114
116
112
100
64
62
102
72
28
14
16
22

144

74
136
122
118

Fig. 7
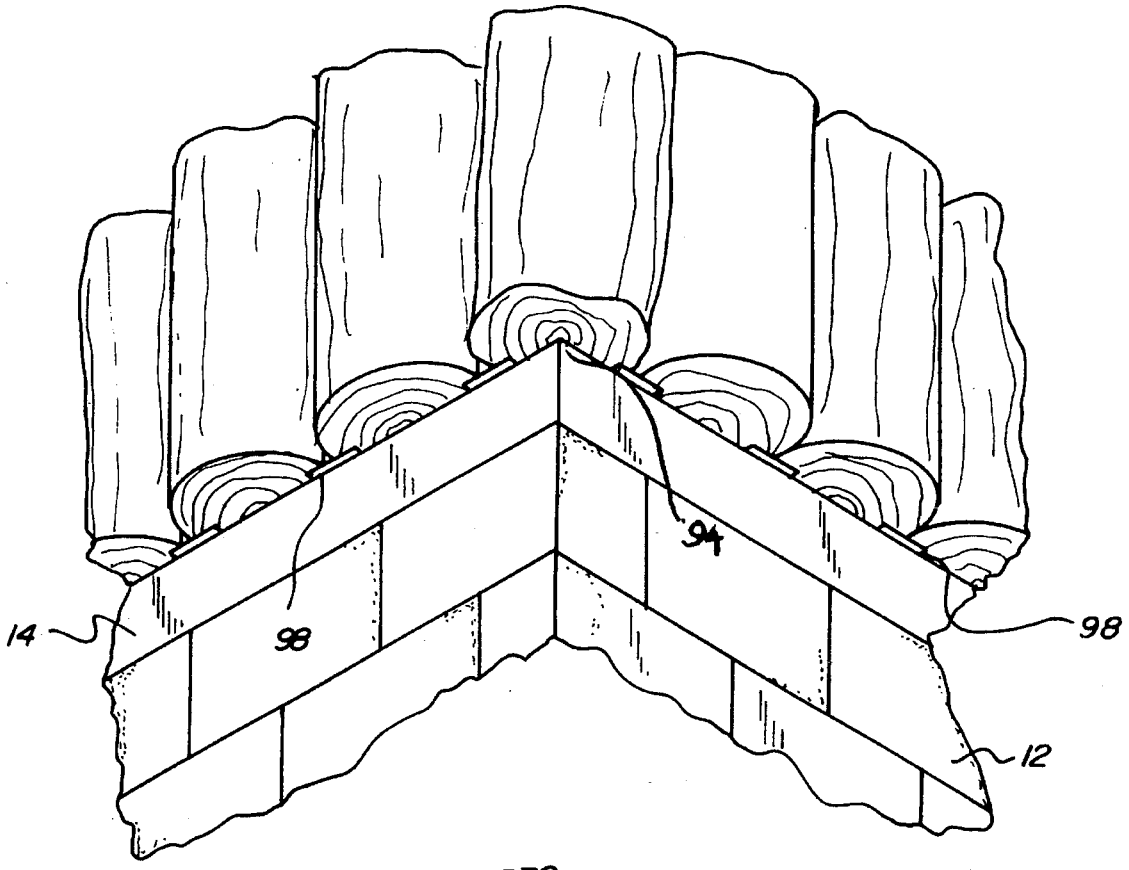
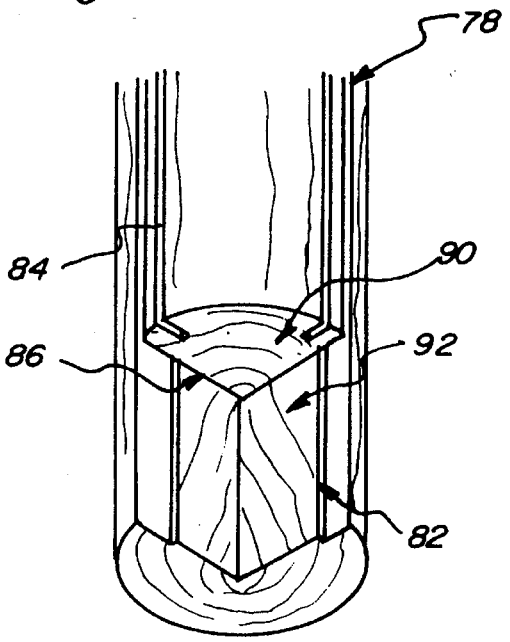
Fig. 8
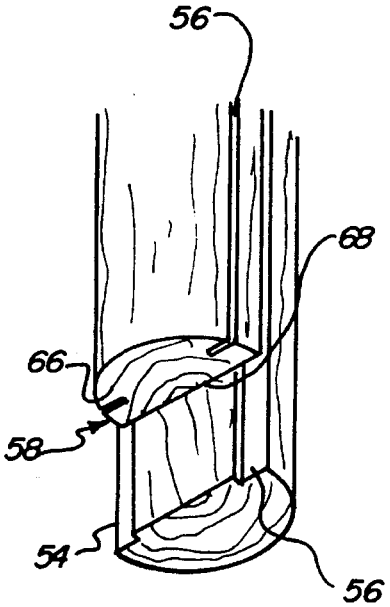
Fig. 9

VERTICAL LOG BUILDING AND METHOD FOR CONSTRUCTING THE SAME

BACKGROUND OF THE INVENTION

1. Field of the Invention

The present invention relates to a vertical log building and method for constructing the same and more particularly pertains to building a log cabin wherein the logs are placed in a vertical orientation for formation of the wall structures, and further providing a method of constructing the log cabin with vertical log construction.

2. Description of the Prior Art

The use of logs is known in the prior art. More specifically, logs heretofore devised and utilized for the purpose of building structures are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,058,343 to Nipko discloses a modular log structures and methods of constructing same. U.S. Pat. No. 4,967,526 to Yost discloses building structures with preassembled, simulated, external log cabin, corner joint units fitting with horizontally extending vertically juxtaposed siding members. U.S. Pat. No. 4,951,435 to Beckedorf discloses a log building construction. U.S. Pat. No. 4,787,185 to Gascho discloses a log structures and method of constructing same. U.S. Pat. No. 4,056,906 to Elfstrom discloses a building frame work for timber house of log-cabin appearance. U.S. Pat. No. 4,034,5247 to Jalasjaa discloses a log cabin construction. Lastly, U.S. Pat. No. 3,863,409 to Fell discloses a log cabin structure.

While these devices fulfill their respective, particular objectives and requirements, the aforementioned patents do not describe vertical log building and method for constructing the same that allows building a log cabin type structure through the use of logs fastened to a foundation along a vertical axis for the purpose of forming walls of the cabin structure.

In this respect, the vertical log building and method for constructing the same according to the present invention substantially departs from the conventional concepts and designs of the prior art, and in doing so provides an apparatus primarily developed for the purpose of building a log cabin wherein the logs are placed in a vertical orientation for formation of the wall structures, and further providing a method of constructing the log cabin with vertical log construction.

Therefore, it can be appreciated that there exists a continuing need for a new and improved vertical log building and method for constructing the same which can be used for building a log cabin wherein the logs are placed in a vertical orientation for formation of the wall structures, and further providing a method of constructing the log cabin with vertical log construction. In this regard, the present invention substantially fulfills this need.

SUMMARY OF THE INVENTION

In view of the foregoing disadvantages inherent in the known types of logs now present in the prior art, the present invention provides an improved vertical log building and method for constructing the same. As such, the general purpose of the present invention, which will be described subsequently in greater detail, is to provide a new and improved vertical log building and method for constructing the same and method which has all the advantages of the prior art and none of the disadvantages.

To attain this, the present invention essentially comprises a generally rectangular foundation that has a floor plate that is attached along an upper portion of the foundation. The floor plate is anchored to the foundation by a plurality of anchor bolts. Included are a plurality of wall structures. Each wall structure has a plurality of vertically oriented logs disposed side by side and a plurality of long corner logs. Each wall structure meeting at one of the corner logs. Each log is secured to the floor plate. The plurality of vertically oriented logs each have a ceiling end and a floor end. Each log has two sides and each side has a pair of rectangular, longitudinally extending slots. Each of the plurality of vertical logs have an L-shaped notch at the floor end and the ceiling end. The L-shaped notch allows each vertical log to have an outer side and an inner side. Each L-shaped notch has a flat base and a notch back. The flat base of the floor end is rested upon a perimeter board of the foundation when the notch back is fastened to the floor plate. Each notch back of each vertically oriented log is fastened to the floor plate with a lag bolt. The corner logs coupling each wall structure has a floor end and a ceiling end. Each corner log has a frontal area with a plurality of rectangular, longitudinally extending slots. The plurality of slots form two outer slots and two inner slots. The floor end and the ceiling end of each corner log has a generally V-shaped notch. Each V-shaped notch has a V-shaped base and a pair of sides. The V-shaped base of the floor end rests upon the perimeter board and the pair of sides of the floor end are fastened to a corner of the floor plate. Each side of the V-shaped notch of the floor end is attached to the floor plate with lag bolts. Also, a plurality of rigid planks are included. Each plank has a width of about two and one half to three inches. One of the planks is positioned within the slots of adjacent vertical logs, while another of the planks is positioned within another of the slots of the same adjacent vertical logs. One plank of the plurality of planks is positioned within the slots of adjacent vertical logs over and over again for formation of at least one of the plurality of wall structures. The one wall structure has an inner space that is formed between the planks positioned within the parallel slots of the adjacent logs. One of the planks is positioned within the inner slots of each corner log and the slots of an adjacent vertical log, while another of the planks is positioned within the outer slots of the same corner log and the slots of another adjacent vertical log. When one of the planks is positioned in the inner slots, the outer slots and the pair of slots of adjacent vertical logs, joining of the plurality of wall structures occurs. Joining the wall structures to the corner logs allows the planks to form the inner space. Included are a plurality of horizontal beams that are positioned within the L-shaped notch of the ceiling end of each vertical log. Lastly, finishing boards are positioned between the plurality of horizontal beams and along an inner side of the vertical logs and the corner logs.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved vertical log building and method for constructing the same which has all of the advantages of the prior art logs and none of the disadvantages.

It is another object of the present invention to provide a new and improved vertical log building and method for constructing the same which may be easily and efficiently manufactured and marketed.

It is further object of the present invention to provide a new and improved vertical log building and method for constructing the same which is of durable and reliable constructions.

An even further object of the present invention is to provide a new and improved vertical log building and method for constructing the same which is susceptible of a low cost of manufacture with regard to both materials and labor, and which accordingly is then susceptible of low prices of sale to the consuming public, thereby making such vertical log building and method for constructing the same economically available to the buying public.

Still yet another object of the present invention is to provide a new and improved vertical log building and method for constructing the same which provides in the apparatuses and methods of the prior art some of the advantages thereof, while simultaneously overcoming some of the disadvantages normally associated therewith.

Even still another object of the present invention is to provide a vertical log building and method for constructing the same for building a log cabin wherein the logs are placed in a vertical orientation for formation of the wall structures, and further providing a method of constructing the log cabin with vertical log construction.

Lastly, it is an object of the present invention to provide a new and improved vertical log building and method for constructing the same including a foundation that has a floor plate attached an upper portion. A plurality of wall structures that are secured to the foundation. Each wall structure has a plurality of vertically oriented logs disposed side by side and a plurality of corner logs. One of the vertical logs joining to one of the corner logs. The plurality of vertically oriented logs each have a ceiling end and a floor end. Each log has two sides that have a pair of slots therein. Each of the plurality of vertical logs have an L-shaped notch at the floor end and the ceiling end. The L-shaped notch allows each vertical log to have an inner side. The L-shaped notch of the floor end is secured to the floor plate. The corner logs coupling each wall structure has a floor end and a ceiling end. Each corner log has a frontal area with a plurality of slots. The plurality of slots form two outer slots and two inner slots. The floor end and the ceiling end of each corner log has a generally V-shaped notch for attaching the corner log to the floor plate. Lastly, a plurality of planks are positioned within the slots of the vertical logs for forming at least one of the plurality of wall structures. The planks being positioned within the inner and outer slots of each corner log for joining the wall structures at each corner log.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side sectional view of the wall structure of the present invention.

FIG. 4 is a cut-away inside view of the wall of the present invention taken along line 4—4 of FIG. 3.

FIG. 7 is a bottom view of the raw structure of the present invention taken along a corner.

FIG. 8 is a sectional view of the end of a corner log of the present invention.

FIG. 9 is a cut-away view of an end of the vertical log of the present invention.

The same reference numerals refer to the same parts through the various Figures.

DESCRIPTION OF THE PREFERRED EMBODIMENT

Figure 1:
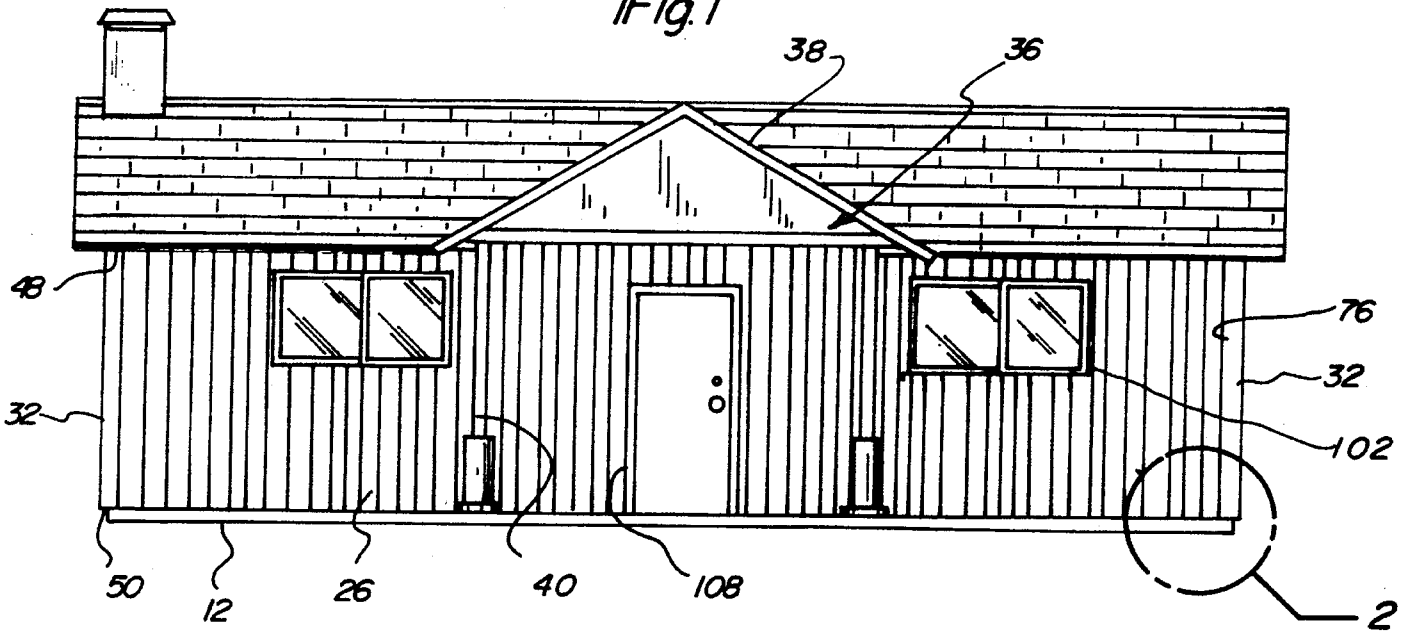
FIG. 1 is a perspective view of the preferred embodiment of the vertical log building constructed in accordance with the principles of the present invention.

With reference now to the drawings, and in particular to FIG. 1 thereof, the preferred embodiment of the new and improved vertical log building and method for constructing the same embodying the principles and concepts of the present invention and generally designated by the reference numeral 10 will be described.

The present invention, the vertical log building and method for constructing the same 10 is comprised of a plurality of components. Such components in their broadest context include a foundation, logs, planks, beams, and finishing boards. Such components are individually configured and correlated with respect to each other so as to attain the desired objective.

Specifically, the present invention includes a generally rectangular foundation 12, as shown in FIG. 1. The foundation has a floor plate 14 that is attached along an upper portion 16 of the foundation. The floor plate is anchored to the foundation by a plurality of anchor bolts 22. FIG. 3 shows an anchor bolt positioned through the floor plate, the underlay seal 24, and the foundation. The foundation is formed of a rigid material, preferably concrete blocks.

Included are a plurality of wall structures 26. Each wall structure has a plurality of vertically oriented logs 28 disposed side by side and a plurality of long corner logs 32. Each wall structure meeting at one of the corner logs, as shown in FIG. 1. Each log is secured to the floor plate 14.

As best illustrated in FIG. 1, a front porch 36 extends from the perimeter of the log building 10. The front porch has a porch roof 38. The roof of the front porch is supported by a pair of wood posts, with each wood post supported by a masonry structure 42 that is positioned on a portion of the foundation that extends beyond the log building.

The plurality of vertically oriented logs 28, each have a ceiling end 48 and a floor end 50. Each vertical log has two sides 54 and each side has a pair of rectangular, longitudinally extending slots 56. Each slot has a width that is slightly larger than the width of a kerf of a saw used in the milling process. Each of the plurality of vertical logs has an L-shaped notch 58 at the floor end 50 and the ceiling end 48.

FIG. 9 shows the L-shaped notch that allows each vertical log to have an outer 62 side and an inner side 64. Each L-shaped notch has a flat base 66 and a notch back 68. Each L-shaped notch cuts through one of the pairs of slots, at the floor end and ceiling end, of each vertical log. The flat base of the floor end rest upon a perimeter board 72 of the foundation, as shown in FIG. 3. The flat base of the vertical log is positioned on the perimeter board while the notch back of the floor end is positioned against the floor plate 14. Each notch back of each vertical log is fastened to the floor plate with a lag bolt 74.

The corner logs 32, that couple each wall structure, as shown in FIG. 1, have a floor end 50 and a ceiling end 48. Each corner log has a frontal area 76 with a plurality of rectangular, longitudinally extending slots 78. The plurality of slots form two outer slots 82 and two inner slots 84. Each outer slot and each inner slot is slightly wider than the width of the kerf of the saw used during the milling process.

The floor end and the ceiling end of each corner log has a generally V-shaped notch 86. The V-shaped notch cuts through the two inner slots at the floor end and the ceiling end of the corner logs, as shown in FIG. 8. Each V-shaped notch has a V-shaped base 90 and a pair of sides 92. The V-shaped base of the floor end rests upon the perimeter board 72, when the pair of sides of the floor end are positioned against a corner 94 of the floor plate 14, as shown in FIG. 7. Each side of the V-shaped notch of the floor end is attached to the floor plate with a lag bolt 74.

The plurality of vertical logs and the plurality of corner logs are preferably made of wood. Each log is preferably a short log that has a substantially cylindrical cross section. Each log has a diameter of about eight to twelve inches. Each log is stained and sealed to give the log color and water resistance.

Also, a plurality of rigid planks 98 are provided. The planks, as shown in FIG. 7, have a width of about two and one half to three inches. One of the planks is positioned within the slots 56 of adjacent vertical logs, while another of the planks is positioned within another of the slots of the same adjacent vertical logs. As depicted in FIG. 4, the planks interlock two of the vertical logs and cause them to be side by side. One of the plurality of planks is positioned within the slots of adjacent vertical logs over and over again to form at least one of the plurality of wall structures 26. When two of the planks are placed within the slots of adjacent vertical logs, the one wall structure has an inner space 100 that is formed between those planks positioned within the parallel slots.

Figure 2:
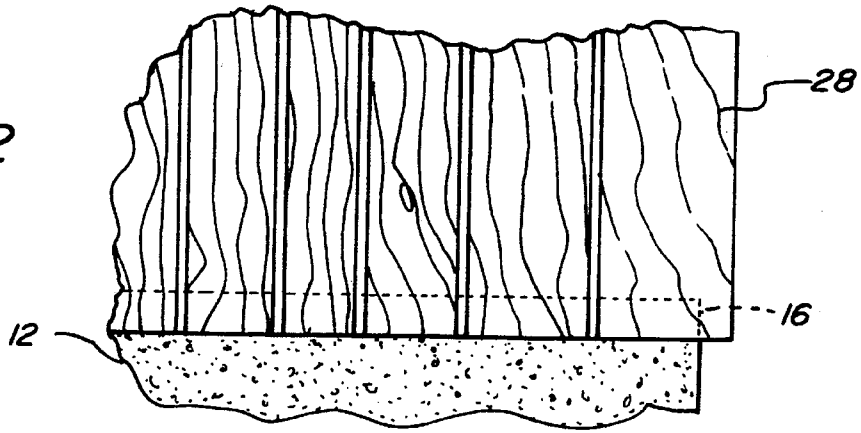
FIG. 2 is a sectional cut-away view of the wall structure of the present invention as positioned on the foundation.

Furthermore, one of the planks 98 is positioned within the inner slots 84 of each corner log and the slots 56 of an adjacent vertical log 28. While another of the planks is positioned within the outer slots 82 of the same corner log and the slot of another adjacent vertical log. As shown in FIG. 2, the planks interlock the corner log with an adjacent vertical log for joining of the plurality of wall structures. The planks, when interlocking the wall structure to each corner log, forms another inner space between the joining of the wall structure with each corner log.

The inner space that is formed between the two planks that are positioned in the slots of the vertical logs and the corner logs may receive insulation. The insulation may be a loose, glass fiber insulation or more dense insulation 102. Preferably, the insulation is a dense insulation that fills the inner space between the two planks. The insulation is continuous and extends the length of the inner space, which extends the entire length of the vertical logs and the corner logs. The use of the logs 28 and 32 with the insulation 102 provides a tight, waterproof interlocking between the logs.

Figure 5:
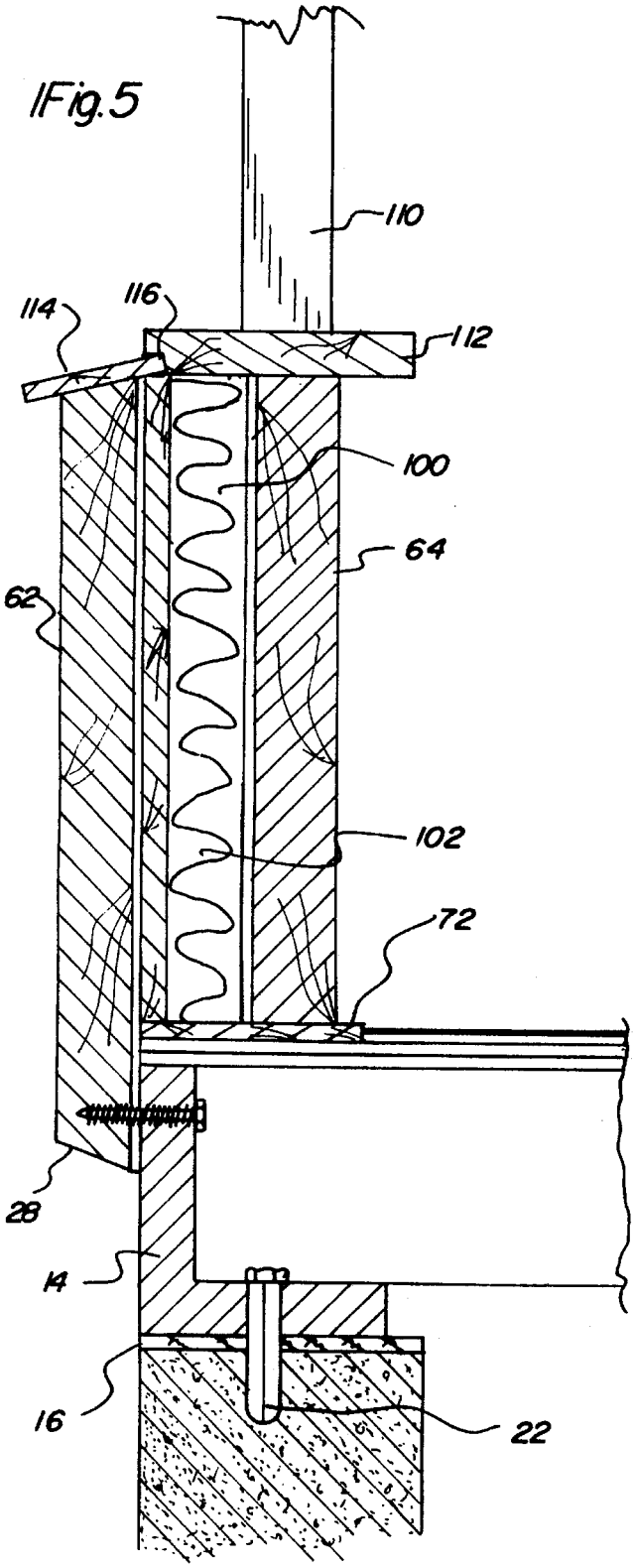
FIG. 5 is a sectional cut-away view of the lower portion of the window structure of the present invention.
Figure 6:
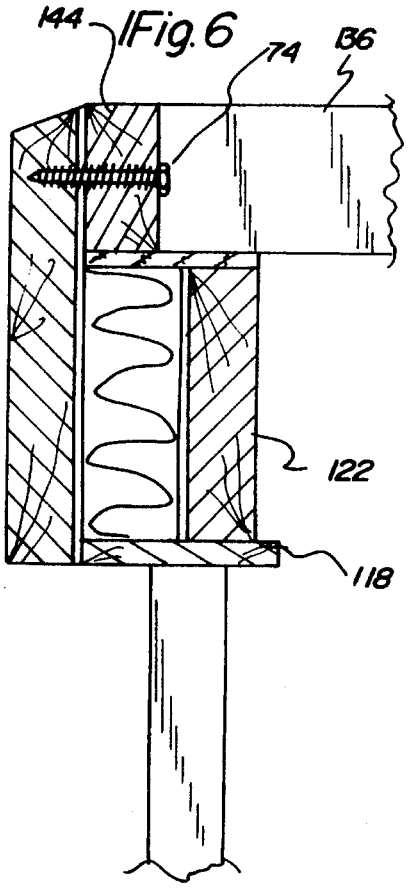
FIG. 6 is a side sectional view of the upper portion of the window construction of the present invention.

As illustrated in FIG. 1, the log building may have window frames 106 and door frames 108. Where the window frames are located, as shown in FIG. 5, the vertical logs including the planks are cut to fit the space between those features. Where the vertical log is cut for the bottom of the window, a window sill is attached above the inner side 64 of the vertical log. A top drip plate 114 is positioned above the cut end of the outer side 62 of the vertical logs. The top drip plate being fitted within the window sill 116. As illustrated in FIG. 6, a top of the window frame 118 is attached to the remaining cut piece 122 of the vertical log.

Once the wall structures have been formed by joining the vertical logs with the planks and the corner logs to the vertical logs with other planks, electrical receptacles may be placed in the walls. As shown in FIG. 4, an electrical receptacle box may be placed within the wall structure. The electrical receptacle box 126 is positioned in boards cut through the vertical logs. The wiring 128 for the electrical conduits of the log building run from the rear of the box, as shown in FIG. 3, and down through an extra groove 130.

The extra groove is cut between the pair of extending slots 56 along the same side one of the vertically oriented logs 28. The extra groove is covered by a stiff paper gasket (not shown), with the paper gasket fastened to the vertical oriented log. The addition of the extra groove aids in easing the wiring instillation within the log. The extra groove and the wiring exit toward the perimeter board with the wiring extending beyond the perimeter board and into a void 132 of the foundation.

A plurality of horizontal beams 136, as shown in FIG. 3, are provided. The beams are positioned within the L-shaped notch 58 of the ceiling end 48 of each vertical log 28. The beams support a plurality of ceiling boards 138 (undesignated) attached to an upper side wall 42 of the beam and perpendicular the beams. The beams are attached to the vertical logs at the ceiling ends with lag bolts 74. The ceiling boards are arranged edge to edge so as to describe a ceiling.

Lastly, as shown in FIG. 3, finishing boards 144 are provided. Finishing boards are positioned between the plurality of horizontal beams 136 and along an inner side of the vertical logs 28. The finishing boards are positioned between the plurality of horizontal beams along the inner side of the corner logs. Furthermore, a roof of conventional structure is attached at the ceiling end of the log building.

The present invention is a vertical log building that is used as a house or similar enclosed structure. The present invention blends old construction with new construction. Preferably, short logs are used in this construction because they are more attainable and of a lighter weight, thereby needing only two people to maneuver the logs around the construction site. The design of the vertical log home is versatile.

It can be made in a circular, curved, cross, or T-shaped houses. The vertical placement of the logs lessens the amount of dust that usually builds up on horizontal shelves of the traditional horizontal log homes. Wiring is easily accommodated between the logs and insulation that is placed between the strips which locking the logs. The wiring procedure can be done either during or after construction of the building. There is no sagging that occurs with the vertical log home. The short logs are bolted up and down, and top to bottom for a very strong wall. Zero clearance is needed for fitting door and window frames. Bottom ends of logs are cut so they will fit over the top of the bottom floor plate and overlap over the side for weather protection. The structure allows for none trapping of water within the natural cracks of the logs. The end user need not be knowledgeable in the field of carpentry of even the use of tools to build or put together the vertical log home. They would lend themselves readily to pre-cut packaged log buildings.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved vertical log building for use as housing or similar enclosed structure comprising in combination:

a generally rectangular foundation having a floor plate being attached along an upper portion of the foundation and anchored thereto by anchor bolts;

a plurality of wall structures with each of the wall structures being formed of a plurality of vertically oriented logs disposed side by side and a plurality of corner logs, each of the wall structures meeting at one of the corner logs and being coupled thereto, each log of the wall structures being secured to the floor plate;

the plurality of vertically oriented logs each having a ceiling end and a floor end, each of the vertical logs having two sides with each side having a pair of rectangular, longitudinally extending slots therein, each of the plurality of vertical logs having an L-shaped notch at the floor end and the ceiling end for allowing each vertical log to have an outer side and an inner side, each L-shaped notch having a flat base and a notch back, the flat base of the floor end being capable of resting upon a perimeter board of the foundation while the notch back of the floor end being positioned against the floor plate, each notch back of each vertical log being fastened to the floor plate with a lag bolt;

the corner logs each having a floor end and a ceiling end, each of the corner logs having a frontal area with a plurality of rectangular, longitudinally extending slots therein, the plurality of slots forming two outer slots and two inner slots, the floor end and the ceiling end of each of the corner logs having a generally V-shaped notch therein, each V-shaped notch having a V-shaped base and a pair of sides, the V-shaped base of the floor end capable of resting upon the perimeter board and the pair of sides of the floor end being positioned against a corner of the floor plate, each side of the V-shaped notch of the floor end being attached to the floor plate with lag bolts;

a plurality of rigid planks having a predetermined width of about 2½ to 3 inches, one of the planks being slidably positioned within the slots of adjacent vertical logs, with another of the planks being slidably positioned within another of the slots of the same adjacent vertical logs, one of the plurality of planks being positioned within the slots of adjacent vertical logs over and over again for formation of at least one of the plurality of wall structures, the one wall structure having an inner space being formed between the planks positioned within the parallel slots of the adjacent logs;

one of the planks being slidably positioned within the inner slots of each corner log and the slot of an adjacent vertical log, with another of the planks being slidably positioned within the outer slots of the same corner log and the slot of another adjacent vertical log for joining of the plurality of wall structures, the planks, when interlocking the wall structures to each corner log forming another inner space between the joining of the wall structures with each corner log;

a plurality of horizontal beams being positioned within the L-shaped notch of the ceiling end of each vertical log; and finishing boards being positioned between the plurality of horizontal beams along an inner side of the vertical logs and the corner logs.

2. A vertical log building comprising:

a foundation having a floor plate being attached along an upper portion of the foundation;

a plurality of wall structures being secured to the foundation, with each of the wall structures being formed of a plurality of vertically oriented logs disposed side by side and a plurality of corner logs and one of the vertical logs joining to one of the corner logs;

the plurality of vertically oriented logs each having a ceiling end and a floor end, each of the logs having two sides with each side having a pair of slots therein, each of the plurality of vertical logs having an L-shaped notch at the floor end and the ceiling end for allowing each vertical log to have an inner side, the L-shaped notch of the floor end being secured to the floor plate;

the corner logs coupling each wall structure having a floor end and a ceiling end, each corner log having a frontal area with a plurality of slots therein, the plurality of slots forming two outer slots and two inner slots, the floor end and the ceiling end of each corner log having a generally V-shaped notch therein, the V-shaped notch of the floor end being attached to the floor plate; and a plurality of planks being positionable within the slots of the vertical logs for formation of at least one of the plurality of wall structures, and positionable within the inner and outer slots of each corner log for joining of the wall structures at each corner log.

3. The vertical log build as set forth in claim 2 wherein the floor plate is anchored to the foundation by a plurality of anchor bolts proportionately spaced throughout.

4. The vertical log building as set forth in claim 2 wherein the slots of the vertical logs being generally rectangular and extending longitudinally, and each L-shaped notch of the vertical logs having a flat base and a notch back along the floor end and the ceiling end, the flat base of the floor end being capable of resting upon a perimeter board of the foundation while a notch back of the floor end being positioned against the floor plate.

5. The vertical log building as set forth in claim 4 wherein the slots of each corner log being generally rectangular and extending longitudinally, and each V-shaped notch of the corner logs having a V-shaped base and a pair of sides, the V-shaped base of the floor end capable of resting upon the perimeter board and the pair of sides of the floor end being positioned against a corner of the floor plate.

6. The vertical log building as set forth in claim 5 wherein lag bolts being positionable within the floor end of the vertical logs and the corner logs for attaching the logs to the floor plate of the foundation.

7. The vertical log building as set forth in claim 2 wherein the planks having a predetermined width of about 2½ to 3 inches, and one of the planks is positioned within the slot of adjacent vertical logs, with another of the planks positioned within another of the slots of the same adjacent vertical logs, and one of the planks is positioned within the inner slots of each corner log and the slot of an adjacent vertical log, with another of the planks positioned within the outer slot of the same corner log and the slot of another adjacent vertical log for joining of the plurality of wall structures.

8. The vertical log building as set forth in claim 7 wherein an inner space being formed between the planks positioned within the slots of the adjacent vertical logs and another inner space being formed between the corner logs and the one vertical log adjacent thereto when the logs being attached to the floor plate of the foundation.

9. The vertical log building as set forth in claim 7 wherein the plurality of planks being positioned within adjacent vertical logs over and over again, and being positioned within corner logs and adjacent vertical logs over and over again forming the vertical log building.

10. The vertical log building as set forth in claim 2 wherein a plurality of horizontal beams being positioned within the L-shaped notch of the ceiling end of each vertical log, with the beams forming supports for a plurality of ceiling boards.

11. The vertical log building as set forth in claim 10 wherein finishing boards being positioned between the plurality of horizontal beams along an inner side of the vertical logs and the corner logs.

12. A method of constructing a vertical log building comprising the following steps:

forming a foundation and attaching a floor plate thereto with a plurality of anchor bolts;

gathering a plurality of short logs having a diameter of about 8 to 12 inches, a plurality of beams, and a plurality of finishing boards;

separating the logs into vertical wall logs and corner logs, the vertical wall logs and the corner logs each having a floor end and a ceiling end;

a first milling of each vertical wall log for placing a pair of longitudinal slots within each side of the vertical wall logs, and a first milling of each corner log for placing a pair of inner slots and a pair of outer slots within a frontal area thereof;

a second milling of each vertical wall log for cutting the floor end and the ceiling end to form a L-shaped notch therein, and second milling of each corner log for cutting the floor end and the ceiling end to form a V-shaped notch therein;

a third milling of some of the vertical wall logs for reducing a length for formation of a window opening therein a wall structure being formed by the plurality of the vertical wall logs;

staining the plurality of logs and sealing the plurality of logs;

sliding a plank within each inner slot and each outer slot of the pair of inner and outer slots of each corner log, each plank protruding slightly from each slot;

sliding a plank within the pair of slots on one side of the vertical logs and leaving the pair of slots on another side of the vertical logs open, each plank protruding slightly from each slot;

raising each corner log onto the foundation, with a crane having a mounted boat winch attached thereto, for fastening the corner log onto the floor plate to stand vertical the foundation;

raising one of the vertical logs onto the foundation, with the crane, for interlocking with the corner log by sliding the open slots of the vertical log over the planks of the corner logs, and attaching the one vertical log onto the floor plate to stand vertical the foundation;

raising another of the vertical logs onto the foundation, with the crane, for interlocking with the one vertical log by sliding the open slots of the vertical log over the planks of the one vertical log, attaching another vertical log onto the floor plate to stand vertical the foundation, and repeating this until at least one vertical wall of the vertical log building being formed;

fastening the vertical logs and the corner logs to the floor plate of the foundation with a lag bolt threadedly engaging the floor end of each vertical log and corner log;

proportionately fastening the plurality of beams along a horizontal with a lag bolt, onto a respective one of the vertical logs, and fastening a plurality of ceiling boards to an upper side of the beams; and attaching a plurality of finishing boards between the plurality of beams fastened to the vertical logs, the finishing boards capable of concealing lag bolts.

* * * * *